United States Patent [19]

Clark

[11] 4,444,515

[45] Apr. 24, 1984

[54] EARRING WATCH

[76] Inventor: Lloyd D. Clark, 15 Conrad St., San Francisco, Calif. 94131

[21] Appl. No.: 262,223

[22] Filed: May 11, 1981

[51] Int. Cl.[3] ..... G04C 21/12; G04C 19/00; G04B 37/12

[52] U.S. Cl. ..... 368/279; 368/73; 368/156; 368/285; 340/802

[58] Field of Search ..... 368/12, 63, 69, 70, 368/72, 73, 82, 83, 230, 239, 240, 241, 242, 250, 255, 278, 279, 282, 285, 156; 84/1.03; 340/802; 58/38 R

[56] References Cited

U.S. PATENT DOCUMENTS

| | | | |
|---|---|---|---|
| 1,446,082 | 2/1923 | Applegate | 368/278 X |
| 1,457,014 | 5/1923 | Zweig et al. | 368/279 |
| 1,972,522 | 9/1934 | Keller | 368/278 |
| 2,179,294 | 11/1939 | Heit | 368/285 |
| 2,576,476 | 11/1951 | Peter et al. | 368/278 |
| 3,014,298 | 12/1961 | Kirshner | 368/285 X |
| 3,140,579 | 7/1964 | Skakel, Jr. | 368/278 |
| 3,192,737 | 7/1965 | Schechter et al. | 368/279 |
| 3,365,877 | 1/1968 | Altman | 368/285 |
| 3,998,045 | 12/1976 | Lester | 368/63 |
| 4,058,972 | 11/1977 | Weick | 368/278 |
| 4,063,111 | 12/1977 | Dobler | 368/156 |
| 4,117,662 | 10/1978 | Van der Lely | 368/279 |
| 4,185,283 | 1/1980 | Clark | 368/73 X |
| 4,215,531 | 8/1980 | Wong | 368/278 X |
| 4,226,082 | 10/1980 | Nishida | 368/285 |

*Primary Examiner*—J. V. Truhe
*Assistant Examiner*—Terry Flower
*Attorney, Agent, or Firm*—David Pressman

[57] ABSTRACT

An earring watch comprises an enclosure 4 with a friction clip or pierced-earlobe hook for attachment to the ear. The enclosure contains an energy cell 18, a timekeeping circuit 42–46–48 and an audio transducer 40 for announcing the time in a series of groups of tones, the number of tones in each group equal to a respective digit of the time. The time is announced when the wearer touches one part of the surface of the enclosure twice, another part 6 of the enclosure is electrically connected to the body via the ear, so that the touch completes a circuit between the two parts of the enclosure. Preferably, and to avoid false readouts due to an inadvertent touch, the watch contains circuitry for providing a time readout only if it is touched twice within a predetermined interval.

7 Claims, 13 Drawing Figures

BLOCK DIAGRAM OF TIMEKEEPING CIRCUITRY

EARRING WATCH ON EAR

BACK OF EARRING WATCH

SIDE OF FRICTION-HELD EARRING WATCH ON EAR

SIDE OF HOOK-ON EARRING WATCH ON EAR

PCB LAYOUT

INTERNAL PARTS LAYOUT

AUDIO TRANSDUCER MOUNTING

BLOCK DIAGRAM OF ELECTRONIC SYSTEM

BLOCK DIAGRAM OF TIMEKEEPING CIRCUITRY

SCHEMATIC DIAGRAM OF
TOUCH SENSING CIRCUITRY

WATCH TOUCHED TWICE... TIME (4:56) IS CHIMED

WRIST WATCH

EARRING WATCH

BACKGROUND

1. Field of Invention

This invention relates to an ornamental timepiece, particularly to such a timepiece which can be worn on one's ear.

BACKGROUND

2. Description of Prior Art

Since timepieces first became portable, they have been worn or carried at various locations on the body. Watches are made to be worn on the wrist, on the lapel of a suit, on a chain, and to be carried in the pocket of a garment. However, insofar a I am aware, no timepiece has been available which can be worn on the ear, much less used by the wearer while being so worn. It would be desirable to provide a timepiece which could be worn and actually used on the ear. Such a timepiece would provide two pieces of jewelry in one: a watch and an earring. It would also provide a timepiece which has no hands, face, or digits, yet which is useful even in high-noise environments. Further it would not require the user to look away from what he or she is watching in order to determine the time.

Recently, technical advances have been made in personal watches which are designed to be worn, e.g., on the wrist. These can now provide an audible time output (coded chimes, verbal, etc.). However the sound produced by these watches was of necessity relatively loud and hence audible and often disturbing to others in the wearer's proximity.

Many readout functions of these and other prior art timepieces are activated by the push of a button. For example in watches which have a light-emitting diode (LED) readout, a button must be pushed to activate the time display. This is done because the visible display requires so much current that it would completely drain the watch batteriers if it were left on for more than a few seconds at a time. Other functions can be activated by a second pushing of the button within a specified time interval. For example in many ordinary digital watches, the date will be displayed if the time-indication-activate button is pushed twice within a short interval. The button mechanism used in these watches requires additional manufacturing steps. A hole must be drilled in the watch case, a spring return must be provided, and finally a separate moisture seal must be provided around the button to keep unwanted moisture out of the watch. It would be desirable to provide a watch which overcomes these deficiencies.

One solution heretofore proposed has been the use of a touch to activate the time display. One such touch-activated timepiece on the marked today is included in the housing of one commercial embodiment of the invention of my earlier U.S. Pat. No. 4,185,283, granted Jan. 22, 1980, manufactured by Chrono-Art, Inc., 9175 Poplar Avenue, Cotati, CA 94928, under the trademark AUDOCRON. Touch sensors are also used to operate light switches in homes, etc. However in all of these devices, their function can be triggered unintentionally since one touch will perform the primary function of reading out the time, turning on or off of the light, etc. In the case of a watch which is worn on the user's body, it would be desirable to prevent such accidential operation of the time indication readout.

OBJECTS

Accordingly one object of my invention is to provide a timepiece which can be worn and actually used on a person's ear. Another object is to provide such a timepiece which can provide a time indication while being worn. A further object is to provide a watch which has a wearer-sensible, non-visual output, yet which is not readily audible or disturbing to others in the wearer's proximity. Still further objects are to provide a watch which can be used in dark and in relatively high-noise environments, and to provide a watch which is especially useful and appealing to the blind and persons with low vision. Still another object is to provide a new item of jewelry.

A further object of my invention is to provide a touch sensor timepiece which cannot be activated accidentally.

Further objects and advantages of my invention will become apparent from a consideration of the drawings and ensuing description thereof.

DRAWINGS:

In the drawings, which are not to scale:

FIGS. 7A and B show two views of an audio transducer as it is mounted on the watch front.

Figure 8:
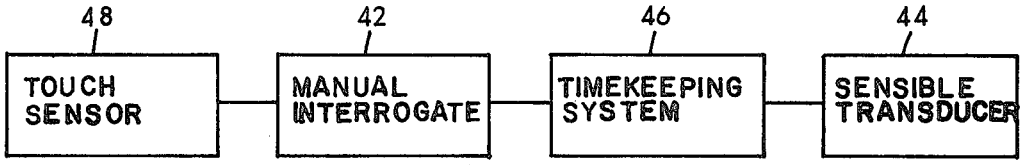

FIG. 8 is a block diagram of the entire electronic system of the watch.

Figure 9:
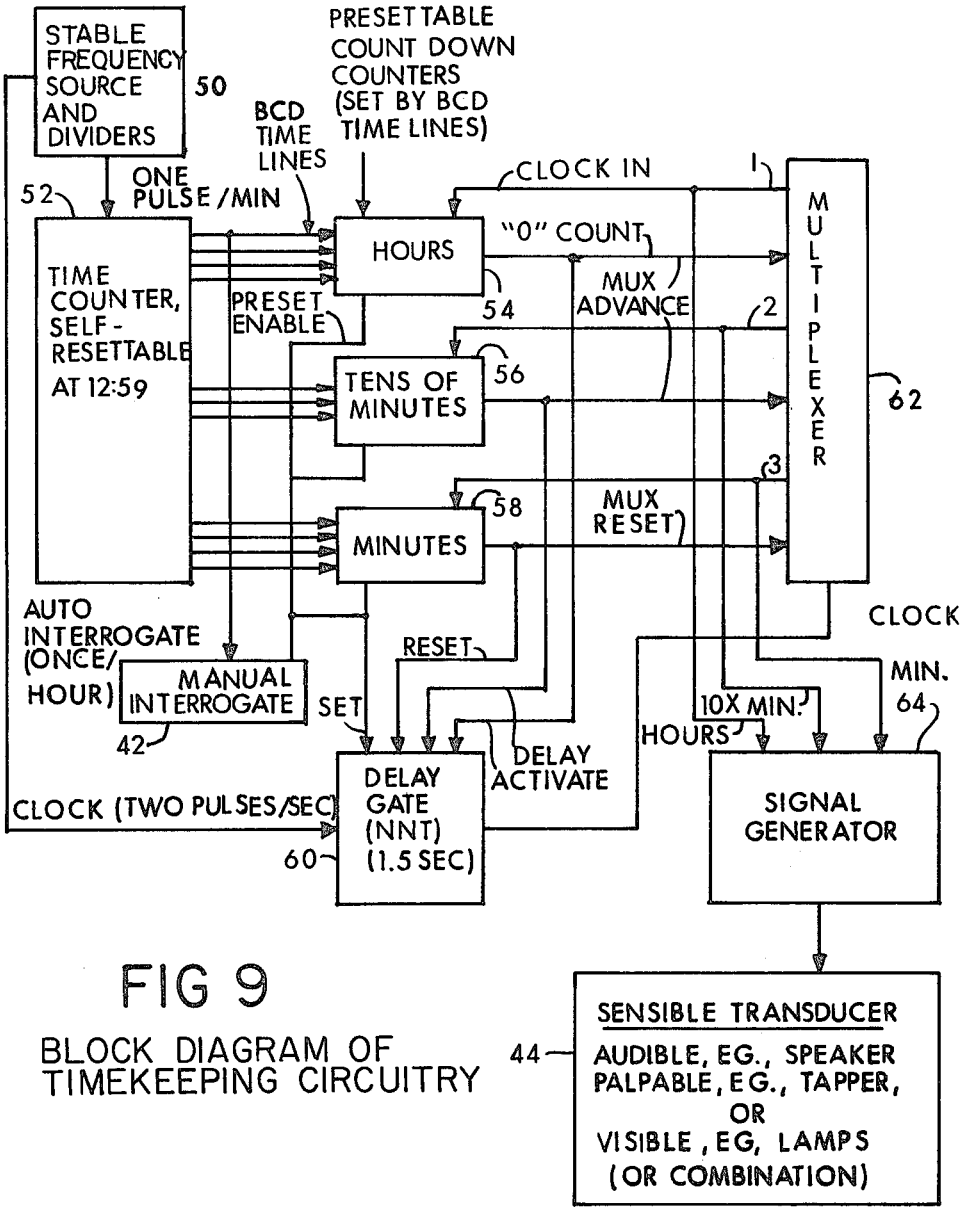

FIG. 9 is a block diagram of the timekeeping portion of the watch circuit.

Figure 10:
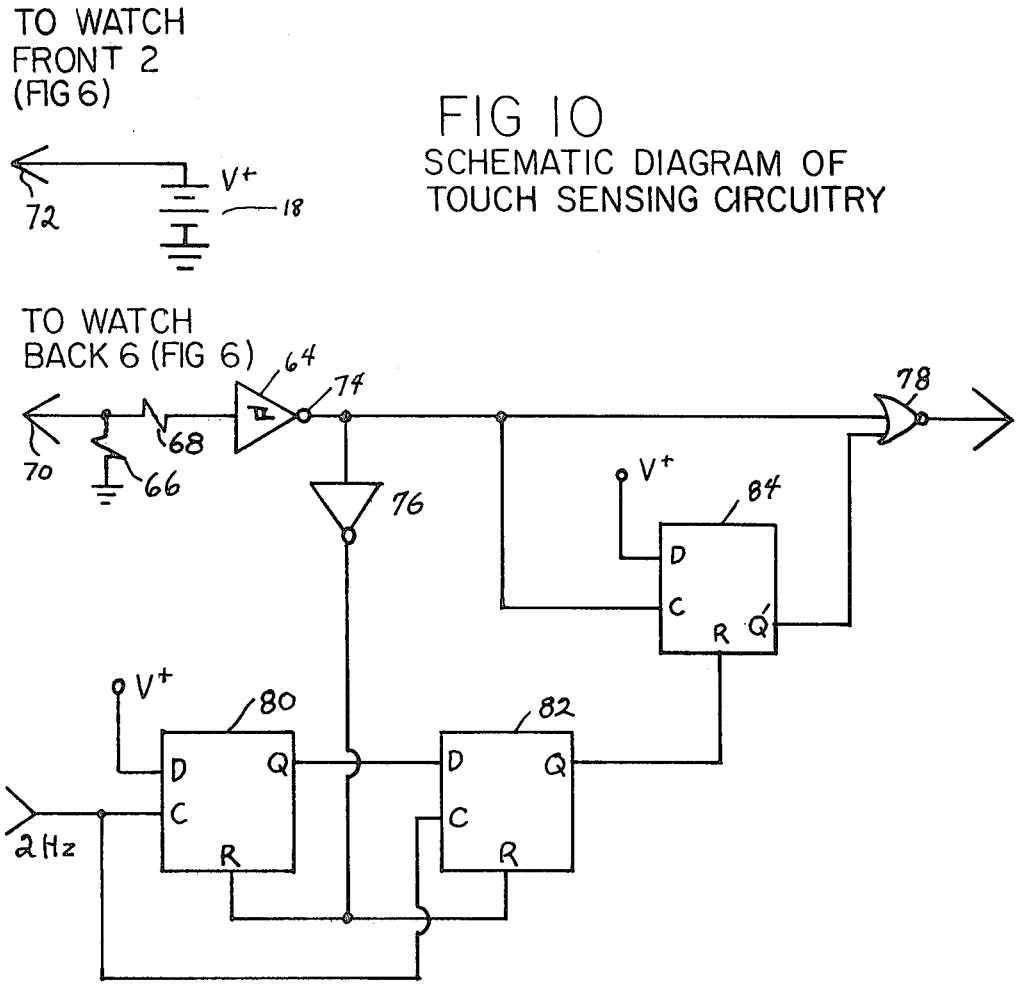

FIG. 10 is a schematic circuit diagram of the touch sensing circuit employed in the watch.

FIGS. 11A and B show the watch in use by the wearer just before and just after the touch sensor has been activated.

Figure 12:
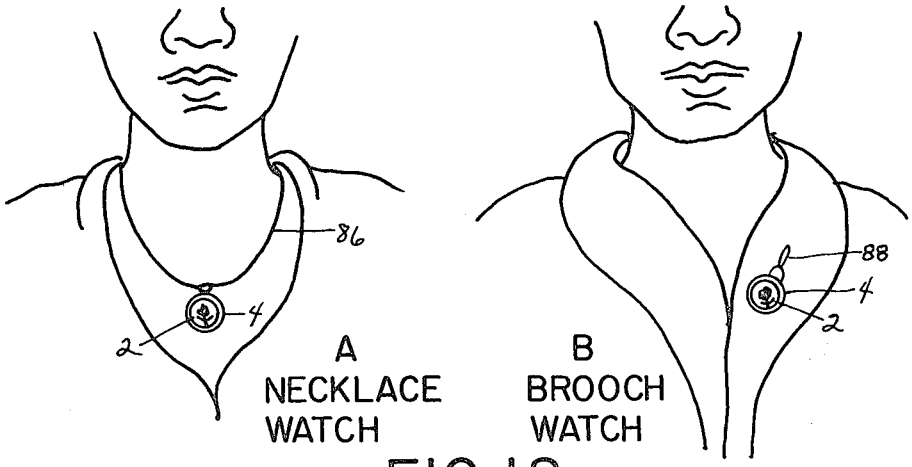

FIGS. 12A and B show, respectively, a necklace and a lapel lapel pin version of the watch.

Figure 13:
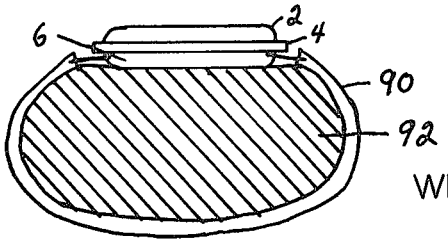

FIG. 13 shows a wrist version of the watch.

DESCRIPTION:

FIGS. 1 through 4—External Views of the Earring Watch

According to the invention, an electronic watch mechanism which provides a non-visual readout of time, i.e., an audible or palpable indication, is provided within an earring. The watch is operated by the wearer's manual interrogation and tells time by audible means, such as a chime, beeping sounds, or speech. FIGS. 1 through 4 show external views of the preferred embodiment of the present invention, an earring-watch. In the front view of FIG. 1, the exterior case of the earring-watch is seen to be circular in shape. An insulator 4 can be seen just behind and around watch front 2.

Figure 1:
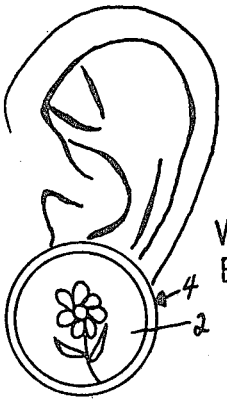
FIG. 1 is a front view of one embodiment of the present invention in place on the user's ear. An optional embossed or engraved design is also shown.
Figure 2:
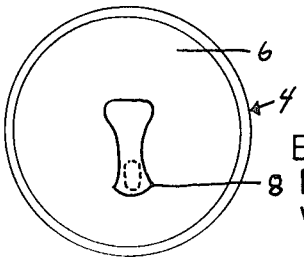
FIG. 2 is a back view of the watch of FIG. 1.

FIG. 2 is a back view of the earring-watch, additionally showing insulator 4, watch back 6 and standard spring ear clip 8. Ear clip 8 is fastened to watch back 6 by solder, screws or a weld joint in well-known fashion. Watch front 2 and watch back 6 are made of a metallic, conducting material such as gold, brass with gold plate, etc.

Figure 3:
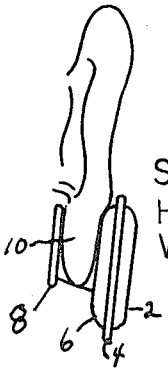
FIG. 3 is a side view of the watch of FIG. 1.

FIG. 3 shows a side view of the earring-watch in place on the user's ear lobe 10. The earring-watch is held in place on ear lobe 10 by friction arising from the force exerted between watch back 6 and ear clip 8.

Figure 4:
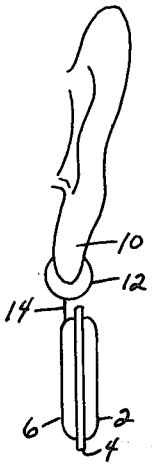
FIG. 4 shows a side view of a pierced-lobe version of the watch in place on the wearer's ear.

FIG. 4 shows a side view of an alternative means for attaching the earring-watch to ear lobe 10. This means of attachment is similar to the familiar pierced earring. In this case ear-lobe-piercing wire 12 passes through ear lobe 10 and hoop 14. Hoop 14 is affixed to watch back 6 by means of a solder joint, weld, etc. Wire 12 and hoop 14 are made of a metal or other conducting material.

Figure 5:
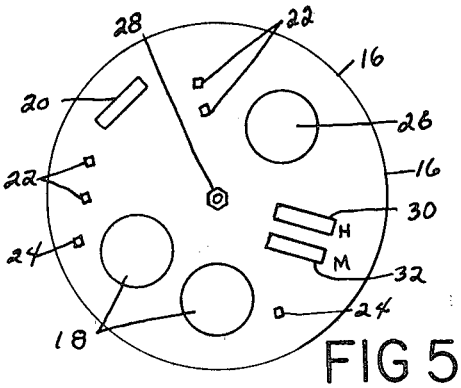
FIG. 5 shows a top view of a printed circuit board and various other components inside the watch.
Figure 6:
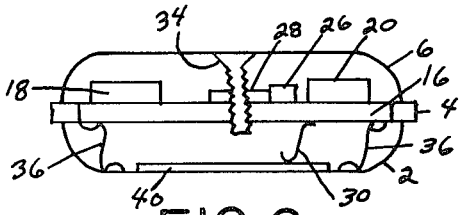
FIG. 6 is a cross-sectional view of the watch showing the locations of the internal components relative to the watch case.
Figure 7:
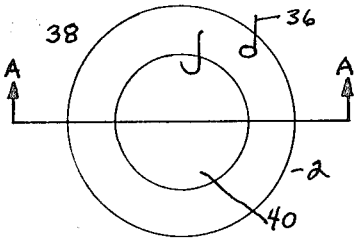
Figure 7:
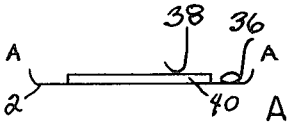

FIGS. 5 through 7—Internal Construction of Earring-Watch

FIG. 5 is a top view of a printed circuit board (PCB) 16 which is mounted in the earring watch; the various electronic components of the watch are mounted on PCB 16. Specifically, energy cells 18, quartz crystal 20, resistors 22, capcitors 24, and integrated circuit 26, all of which comprise the timekeeping system of the watch, are mounted in standard fashion on PCB 16. Watch back 6 is attached to PCB 16 by means of screw 34 (FIG. 6) threaded into mounting nut 28 which is attached to PCB 16 by a solder bond. Two simple leaf switches 30 and 32 made of a spring material such as phosphor bronze are used as set switches. One end of each switch is soldered to printed circuit board 16. The other end is bent slightly away from board 16. To operate these switches, the free end of the switch is pressed down into contact with another part of the circuit on the board, thereby making electrical contact with this second part. This second part of the circuit is connected to integrated circuit 26 and it advances the minutes or hours counters of time counter 52 (FIG. 9), depending on which leaf switch is closed.

FIG. 6 shows the watch in cross-section. Mounting screw 34 is a flat-head screw. It is bonded, e.g. with solder, to watch back 6. Mounting nut 28 is electrically connected to touch sensor 48 (FIGS. 8 and 10) via PCB 16. This connection attaches watch back 6 to terminal 70 of FIG. 10. Connections 36 to watch front 2 are multiple wires which are soldered at one end to PCB 16 and at the other end to watch front 2. These connections serve a second purpose: they fasten PCB 16 to watch front 2. Insulator 4, made of acrylic plastic or another insulating material such as a decorative stone, forms an annulus around PCB 16 and is held in place by a glue bond. Connection 38 to audio transducer 40 is a spring contact (see FIGS. 7A and B). It is soldered to PCB 16 at one end, and springably urged against the top contact of audio transducer 40 at the other. The fastening of a watch back 6 and watch front 2 to PCB 16 as shown in the figure serves to hold the watch together as a single unit.

FIGS. 7A and B are two views of audio transducer 40 as it is mounted on watch front 2. Audio transducer 40 is mounted on watch front 2 instead of watch back 6 in order to facilitate coupling of the sound energy to the air and thence to the user's ear. If audio transducer 40 were mounted on watch back 6, much of the audio energy generated during the readout of the time would be coupled directly into ear lobe 10. The audio vibrations would be damped by ear lobe 10, resulting in a wasting of the sound energy.

Audio transducer 40 consists of a thin wafer of lead-zirconate-titanate (commonly known as PZT). This is a piezoelectric substance, well known in the art, which undergoes mechanical strain in response to electrical stress. It is manufactured by Gulton Industries, 212, Durham Avenue, Metuchen, NJ 08840, and others. The most common shape of transducers made from sintered plates of this compound is a circular disc as shown in FIGS. 7A and B. A common size, and the size used in this application, is approximately 0.025 cm (0.010") thick with a diameter of 2.032 cm (0.8"). Both the bottom and top surfaces are typically coated with a metallic contact material, such as silver. Electrical contacts can be made to these electrodes. If alternating or pulsating current of an appropriate frequency is applied between these electrodes, the PZT will alternately become thicker and thinner in well-known piston fashion. This motion can be coupled to a larger surface and if the larger surface is sufficiently thin and pliable, and amplification of the sound arising from the PZT wafer will result.

In the present embodiment of this invention, the PZT wafer is bonded to watch front 2. Thus watch front 2 and transducer 40 comprise sensible transducer 44 (FIGS. 8 and 9). By virtue of this bonding and the fact that watch front 2 is made of a metallic conductor, electrical contact 72 to the opposite electrode on the PZT disc can be made via watch front 2.

FIG. 8—Block Diagram of Entire Electronic System

FIG. 8 shows a block diagram of the preferred embodiment of the electronic system used in the present invention. With the exception of manual interrogate 42 and sensible transducer 44, the timekeeping system of FIG. 9 is represented in this drawing by block 46 labeled "Timekeeping System of FIG. 9." Manual interrogate 42 and sensible transducer 44 are identified separately in order to clarify the description of one preferred embodiment of this invention. A touch sensor switch 48 is employed as the link between the user and manual interrogate 42 in the present invention for two principal reasons. For aesthetic considerations in the design of jewelry, it is desirable to conceal or disguise electrical switches. This is easily accomplished in the present invention because closure of only a single switch is required to operate the audible readout circuitry. Second, because of the very high reliability of semiconductor components, solid-state switches are less prone to fail after a given number of operations than are mechanical switches.

Positive logic is assumed in the present discussion, i.e., a logical "0" refers to zero voltage, and a logical "1" nominally refers to the power supply voltage V. In the present embodiment, manual interrogate 42 is rendered operational by touch sensor 48. When manually contacted, the output of touch sensor 48 makes a transistor from a logic 0 to a logic 1, activating manual interrogate 42 and causing the audible readout circuitry of timekeeping system 46 to read out the time of day through sensible transducer 44, as described above in the discussion of FIG. 7.

FIG. 9—Block Diagram of Electronic Timekeeping System

FIG. 9, which is a reproduction of the single drawing figure contained in my earlier U.S. Pat. No. 4,185,283, granted Jan. 22, 1980 and titled Multiple Character Word Indication System Employing Sequential Sensible Indicia, shows a block diagram of a timekeeping system used in the present invention. The operation of the system of FIG. 9 will be briefly reviewed to provide a background for understanding the present invention more readily. The system of FIG. 9 provides an audible indication of time by means of a series of groups of tones or chimes, each group representing one digit of the time and having a number of tones equal to the digit it represents.

In FIG. 9 stable frequency source and dividers 50 and self-resettable time counter 52 are both well known in the art; they are found in most electronic timepieces. Briefly, source 50 generates pulses at a high, stable frequency, say 32,768 Hz, and divides this frequency down to provide two outputs, the left output supplying two clock pulses per second and the bottom output supplying one pulse per minute, both with a 50% duty cycle. Time counter 52 counts the minute pulses in horological fashion and provides a continuous binary coded decimal (BCD) parallel output on the eleven lines leading from the right side of counter 52. Specifically, the bottom four outputs of counter 52 represent minutes, the least significant digit of the time, the middle three outputs represent tens of minutes, and the top four outputs represent hours, the most significant digit of the time. For example at the time 12:34, the binary outputs of counter 52 would read (from top down) 1100, 011, 0100 in accordance with well known binary representations indicating powers of two. (The tens of minutes output has only three lines since this digit need have only a maximum value of six.) As indicated, counter 52 resets at 12:59 and can be manually set to any desired time by well known setting controls (indicated in FIG. 5).

The BCD time lines will set three presettable countdown counters, 54, 56 and 58, provided that the PRESET ENABLE inputs at the bottoms of these counters are activated. When any of these counters is thus set and clock pulses are supplied to its upper input, the counter will provide an output on its right "zero-count" lead when it has received its preset number of pulses, i.e., the counter has decremented to zero.

The two-per-second clock pulses supplied by source 50 are applied to a delay gate 60 which is normally non-transmissive (NNT), but which will pass the clock pulses through to its right output when its SET input is activated. When either of the two Delay Activate inputs of gate 60 is activated, the gate will be rendered non-transmissive for 1.5 seconds (three clock pulses). When the RESET input of gate 60 is activated, gate 60 will be rendered non-transmissive until its set input is once again activated.

After passing through gate 60, the clock pulses are applied to multiplexer or distributor 62 which has three outputs, 1, 2, and 3, and which initially supplies the clock pulses at its "1" output to hours counter 54. Upon return of a zero count/multiplex (MUX) advance output from counter 54, multiplexer 62 will advance and will supply the clock pulses at its "2" output to tens of minutes counter 56. Upon return of a MUX advance output from counter 56, multiplexer 62 will then supply the clock pulses at its third output to minutes counter 58. Upon return of a zero count/mux reset from counter 58, multiplexer 62 will be reset and will be arranged to once again supply clock pulses, when received, to its "1" output.

Multiplexer 62 also supplies the clock pulses in sequence to the three inputs of a signal generator 64, which is arranged to provide three different driving signals at sensible transducer 44, which in turn provides a humanly-sensible output. In the preferred embodiment generator 64 provides sequential groups of audio signals of three different frequencies and sensible transducer 44 may comprise a loudspeaker or other audio transducer. The above concept is readily adapted to a two-tone system, instead of one which uses three tones.

The system includes a manual interrogate control 42, which when actuated, e.g. by a pushbutton or touch sensor, activates the PRESET ENABLE inputs of counters 54, 56 and 58 and also sets the delay gate 60, rendering its transmissive. Manual interrogate control 42 is also supplied with an input from the top output of counter 52 which is active once per hour; thus the PRESET ENABLE inputs of counters 54, 56 and 58 and the SET input of delay gate 60 are also activated once per hour automatically. If desired this automatic interrogation feature can be rendered inoperative by merely disconnecting the input between manual interrogate control 42 and the top output of counter 52.

FIG. 10—Touch Sensor

Touch sensor circuit 48 (FIG. 8) is shown in detail in FIG. 10. It consists of Schmitt trigger 64, resistors 66 and 68, flip-flop circuits 80, 82 and 84, and nor gate 78. Flip-flops 80, 82 and 84 are "D-type," i.e. during a single positive clock transition, the logic input present at the "D" input is transferred to the "Q" output. These devices are well known in the art, as is Schmitt trigger 64, and preferably are fabricated of Complimentary Metal-Oxide Semiconductor (CMOS) components. The relatively high input impedance of these devices makes possible the action of touch sensor 48 (FIG. 8) with very low input currents. This is necessary, as will be seen from the discussion below. Additionally, low power consumption is important in the present embodiment since in order that the watch will be as small and lightweight as possible, extremely small batteries must be used as the power source.

Terminals 70 and 72 comprise the external connections to touch sensor 48. Terminal 72 is connected to the positive terminal of watch power supply battery 18 and to watch front 2 (FIG. 6). Terminal 70 is connected to the junction of resistors 66 and 68 and to watch back 6 (FIG. 6). In the present embodiment watch power supply battery 18 consists of two 1.5 volt, standard watch cells. When there is no connection between terminals 70 and 72, resistor 66 normally holds the input of Schmitt trigger 64 at ground, or logic 0. Resistor 68 is included as current-limiting device. It has no effect on the operation of the circuit under normal conditions. It only acts to prevent a potentially destructive, large inrush of current into Schmitt trigger 64 should terminal 70, for some reason, be connected to a voltage higher than the battery supply voltage, V. This can happen, for example, in the case of a static discharge to terminal 70.

It is necessary that the readout circuitry will not operate from a chance or accidental touching of sensor 48. In the preferred embodiment of this invention flip-flops 80, 82 and 84, and NOR gate 78 act together to insure that the audible readout of timekeeping system 46 (FIG. 8) will not be initiated unless a first touch is followed by a second, and further that the second touch occurs within one-half second of the release of the first.

Schmitt trigger 64 is used instead of, for example, a comparator because when its input is operated very near the switching threshold, the output terminal of a comparator can oscillate between a logical 0 and a logical 1. (This phenomenon is associated with the practical, non-ideal behavior of a comparator.) Thus a single touch could be interpreted by flip-flops 80, 82 and 84, and NOR gate 78 as two touches, resulting in a false and undesired triggering of the readout circuitry of time-keeping system 46. The input hysteresis of Schmitt trigger 64 makes this undesirable false triggering much less likely to occur.

The user can activate Schmitt trigger 64 by merely interconnecting terminal 72 to terminal 70 with the body, thereby closing the circuit between terminals 70 and 72. The switching threshold of Schmitt trigger 64 is set so that output 74 will change state from a logic 1 to logic 0 when the input voltage at terminal 70 reaches 2V/3 or more. Output 74 will change state from logic 0 to logic 1 when the input voltage at terminal 70 is V/3 or less. This hysteresis is characteristic of Schmitt triggers in general. The input resistance of CMOS integrated circuits is typically $10^{12}$ ohms when they are operated at the voltages normally encountered in a watch (typically 1.5 to 3 volts). The resistance measured from one point to another on a human body is typically of the order of one megohm. The value of resistor 66 is chosen here to be 10 megohms. Thus when the user interconnects terminals 70 and 72 with any part of the body, terminal 70 is raised to a potential determined by the value of the user's body resistance and the value of resistor 66. Resistor 68 typically has a value of one megohm. In view of the extraordinarily large input resistance of Schmitt trigger 64, resistor 68 has no effect on the circuit, except under unusual circumstances as described above.

Assume resistor 66 has a value of 10 megohms and that the user's body resistance applied between terminals 70 and 72 is one megohm. When the user contacts terminals 70 and 72, the resistive divider formed by resistor 66 and the user's body resistance of one megohm will cause the potential at terminal 70, and thus the input to Schmitt trigger 64, to be raised to $VR_{66}/(R(\text{body})+R_{66})=0.9V$. This surpasses the input threshold, 2V/3, of Schmitt trigger 64. Therefore output 74 of Schmitt trigger 64 will change logic state from logical 1 to logical 0.

As mentioned above, flip-flops 80, 82 and 84 are clocked only on positive-going clock transistions. Thus, although output 74 of Schmitt trigger 64 is connected to the clock input of flip-flop 84, no change can occur at its output as a consequence of this first touch. Reset inputs, R, of flip-flops 80 and 82 are connected through an inverter to output 74 of Schmitt trigger 64. In its quiescent state (input terminal 70 at ground potential), output 74 of Schmitt trigger 64 is at logic 1. Thus the clock input of flip-flop 84 is high, as is the input of inverter 76. The output of inverter 76 is low, as are the reset inputs of flip-flops 80 and 82. Flip-flops 80 and 82 are continuously being checked by a 2 Hz signal. This signal is obtained from stable frequency source and dividers 50 (FIG. 9).

With their reset terminals held low (inactive), and the D (data) input of flip-flop 80 held at logic 1, the Q output of flip-flop 80 assumes a logic 1 after one positive-going transition of the clock input. The Q output of flip-flop 80 is connected to the D input of flip-flop 82. Thus output Q of flip-flop 82 will assume the logic state of the Q output of flip-flop 80 after one positive-going transition of its clock input. After a logic 1 has propagated from the D input of flip-flop 80 to the Q output of flip-flop 82, the R input of flip-flop 84 will be held at a logic 1. This, in turn, causes output Q' of flip-flop 84 to be held at a logic 1. Output Q' of flip-flop 84 is connected to one input of 2-input NOR 78. When output Q' of flip-flop 84 is at logic 1, NOR gate 78 is rendered non-transmissive to logic state changes occuring at its other input. In this condition, the output terminal of NOR gate 78 is held at logic 0.

When terminal 70 is raised above the switching theshold of Schmitt trigger 64, output 74 of Schmitt trigger 64 changes states from logic 1 to logic 0. This also causes the upper input of NOR gate 78 to change to a logic 0. at the same time, the clock input of flip-flop 84 changes from logic 1 to logic 0. Since these flip-flops only change state on positive-going clock transitions, no change will occur at output Q' at this time.

When output 74 of Schmitt trigger 64 changes from logic 1 to logic 0, the output of inverter 76 simultaneously changes from logic 0 to logic 1. This raises the R inputs of flip-flops 80 and 82 to a logic 1, causing the flip-flops to be reset. This results in the Q outputs of flip-flops 80 and 82 changing to a logic 0.

If the touch input at terminal 70 is released while flip-flop 82 is in this condition, causing terminal 70 to return to logic 0, output 74 of Schmitt trigger 64 will return to logic 1. This will cause the compliment of the logic 1 value permanently connected to the D input of flip-flop 84 to be clocked through to output Q'. Thus Q' will make a transition to logic 0. The output of NOR gate 78 will not have changed yet because its upper input is now a logic 1 and its output will remain at logic 0.

If, however, terminal 70 is again connected to terminal 72, causing the input of Schmitt trigger 64 to return to logic 1 and its output to return to logic 0, both inputs of NOR gate 78 will now be at logic 0 and the output of NOR gate 78 will make the transition from logic 0 to logic 1. This transition will activate manual interrogate 42, which in turn causes the audible readout of the time te be presented, as discussed above in connection with FIG. 9.

As soon as the connection between terminals 70 and 72 was released, the R inputs of flip-flops 80 and 82 were returned to logic 0. The input of flip-flop 80 is permanently held at logic 1. Thus, the 2 Hz signal will clock this logic 1 through flip-flop 80. If the R inputs made the transition to logic 0 an instant before the next positive-going transition of the 2 Hz signal, the logic 1 would immediately propagate through to output Q of flip-flop 80. On the next positive-going transition of the 2 Hz signal, the logic 1 valve at output Q of flip-flop 80 will be clocked to the Q output of flip-flop 82. This will reset flip-flop 84, causing its Q' output to assume a value logic 1. This will again render NOR gate 78 non-transmissive. If the connection were released an instant after a positive-going transition of the 2 Hz signal, then NOR gate 78 would have been rendered transmissive to the second touch for an additional one-half second. Thus a second connection between terminals 70 and 72 must be made between one-half second and one second after the first connection is released in order for manual interrogate 68 to be activated.

In one preferred embodiment the invention was implemented in integrated circuit form by selectively interconnecting uncommitted gates on a semi-custom gate array chip to provide a logic circuit in accordance with the block diagram of FIGS. 8 through 10. Such chips and interconnecting fabrication service are widely available and the techniques are well known; e g. from California Devices, Inc., 282 Kinney Drive, San Jose, CA 95112

Figure 11:
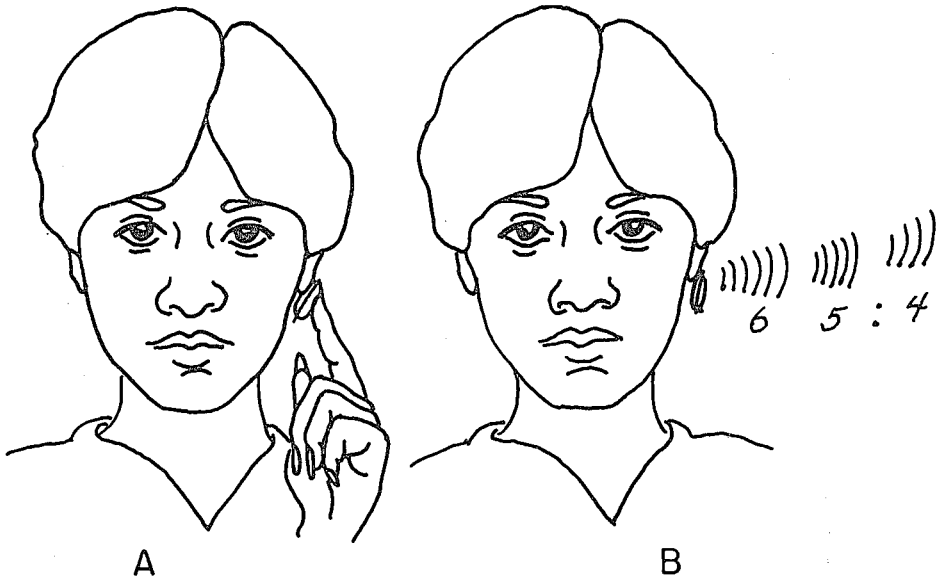

FIG. 11—Demonstration of the Earring-Watch in Use

FIG. 11A and B show the watch in use by a wearer. In FIG. 11A the wearer is touching (or pinching, as described below) the watch twice in order to activate the audible readout mechanism. In FIG. 11B, which depicts the wearer just after the wearer has touched the watch, sound waves representing the audible readout of the watch at time 4:56 are shown radiating outward. Pleasing chime sounds are used in the preferred embodiment.

OPERATION:

Time Setting

In order to set the time, the user first presses both set switches 30 and 32 (FIG. 5) so they make contact with the printed circuit beneath them on printed circuit board 16. When both switches are simultaneously depressed, timekeeping circuit 46 (FIG. 8) will issue a special command to time counter 52 (FIG. 9), causing all counters to be reset to zero. When these switches are released, the hours counter in time counter 52 will automatically be set to 1. Thus, after depressing and releasing the two time-setting switches, the watch will be set to 1:00.

Set switches 30 and 32 are marked "H" (hours) and "M" (minutes), respecitvely. Whenever set switch 30 is depressed, time counter 52 will advance one hour. Whenever set switch 32 is depressed, time counter 52 will advance one minute. Thus to set the watch to 4:13 o'clock from the initial setting (1:00), the user would press the "H" switch (30) three times and the "M" switch (32) thirteen times.

Readout

To activate the readout mechanism while the watch is worn on user's ear lobe 10, the user merely touches watch front 2 twice with a finger. Since terminal 70 is already touching the wearer's body at the ear, touching of the other terminal 72 with the finger connects the body resistance between these terminals, thereby effectively resulting in a closing of the circuit between terminals 70 and 72. As soon as this circuit is closed, the audio readout will begin. A two-tone chime code is used in the present embodiment, with low notes being used to indicate the number of hours, high notes being used to indicate the number of tens of minutes, and the low notes again being used to indicate the number of minutes after the last ten-minute interval. For example, at 4:56 o'clock the watch will chime out the following sequence of tones: low, low, low, low; space; high, high, high, high, high; space; low, low, low, low, low, low. Each tone lasts approximately one-fourth second. The tones in each group are separated by one-half second. The spaces are 1.5 second intervals which serve to remove any ambiguity in the sound code and also make it simple to understand.

Instead of touching the watch, it is also possible to activate he audible readout by pinching the case twice with the fingers, lips, or any other convenient part of the body. The only requirement is that both sides of the case must be simultaneously contacted by the body, as described above. The small current necessary to trigger the touch sensor and initiate the audible readout passes from one side of the case, through the body, to the other side of the case.

As will be apparent to those skilled in the art, the system described is susceptible of many ramifications and some of these will be briefly described.

A three-note audible readout, instead of the two-note audible readout described above, could also be used. A palpable readout could be provided, consisting of a solenoid-operated tapper or buzzer also as described in my above-mentioned earlier patent. Alternatively, a voice output could announce the time. In this case timekeeping circuit 46 would incorporate the necessary electronics to generate words representative of the time and audio transducer 26 would be loudspeaker (or earphone) capable of reproducing the sounds of speech. A number of watch manufacturers are presently working to provide compact "talking watches." A related development, slightly larger than a watch is presently sold by Sharp Corporation, of Japan under the trademark TALKING TIME.

The earring watch described above may be worn singly on one ear. Alternatively a matching earring with a case identical to that of the watch, but which does not contain any internal components could be worn on the other ear if desired.

FIGS. 12A and B. Necklace and Lapel Versions

FIG. 12A shows a necklace version of the preferred embodiment. This version could also easily be adapted to mounting on the wearer's lapel as shown in FIG. 12B, if desired. This would be done by simply removing chain 86 and replacing it with an appropriate lapel pin 88. Because of the way in which they are suspended, the audible time readout in the case of the lapel and necklace embodiments would most conveniently be activated by two pinches, as described above, instead of two touches.

FIG. 13—Wrist Version

FIG. 13 shows a wrist watch version of the preferred embodiment. The watch is held on the wrist 92 by ordinary wrist band 90. In this case terminal 70 of touch sensing circuit 48 is firmly secured to the user's body through watch back 6, as described above. Thus in this embodiment, two touches would be applied to watch front 2 (located away from the wearer's wrist) in order to activate touch sensor 48.

It is thus seen that in accordance with the invention, a wearer-sensible, non-visual time indication output is provided. Further this time indication output is usable to the wearer, but since it is adjacent the ear, it need not be loud enough to be readily audible nor disturbing to others in the wearer's proximity. Further, the various embodiments described above may all be placed next to the user's ear to provide a watch which can be used in relatively high-noise environments. Additionally the watches described above can be used in the dark, or by persons with limited vision or by the blind. Still further benefits accrue from the touch sensing switch provided in the above embodiments. A positive, two-touch activation of the audible time indication output prevents unwanted false triggering, thus providing a reliable means for initiating the output. The watch also provides an attractive, highly novel item of jewelry which has a useful as well as ornamental function.

While the above description contains many specificties, these should not be construed as limitations on the scope of the invention, but rather as an exemplification of one preferred embodiment thereof. Many other variations are possible, for example the visible and palpable readouts briefly mentioned above and described at greater length in my earlier U.S. Pat. No. 4,185,283. Accordingly, the scope of the invention should be determined not by the embodiments illustrated, but by the appended claims and their legal equivalents.

I claim:

1. An earring watch comprising:

(a) an enclosure having affixing means thereon for removably affixing said enclosure to a human earlobe as an earring, said affixing means being electrically insulated from another part of said enclosure, (b) timekeeping means, positioned within said enclosure and arranged to provide a time indication which is sensible to a wearer when said enclosure is worn as an earring, and (c) an electronic circuit within said timekeeping means, said circuit containing a pair of input terminals and arranged so that when said input terminals are interconnected by less than a predetermined impedance twice within a given time interval, a readout of time is provided by said timekeeping means, one of said input terminals being connected to said affixing means and the other of said input terminals being connected to said other part of said enclosure, whereby a wearer of said earring can activate said watch to read out time by touching said other part of said enclosure twice within said given time interval but said watch will not readout the time if said otherpart of said enclosure is touched accidentally or inadvertently.

2. A timepiece, comprising:

(a) timekeeping means arranged to indicate elapsed time by means of a humanly-sensible readout upon receipt of a predetermined input, said timekeeping means being fabricated within an enclosure having a fixed, conductive area on its surface, and (b) touch-sensitive readout activating means within said enclosure and connected to said conductive area of said enclosure, said activating means arranged to provide said predetermined input to said timekeeping means only upon receipt of at least two touches thereto within a predetermined interval.

3. The watch of claim 2 further including means for removably attaching said timepiece to a human body or the vestments worn thereon.

4. The watch of claim 3 wherein said enclosure has first and second conductive portions which are electrically insulated from each other, one of said conductive portions being in electrical contact with a part of said wearer's body when said watch is worn, said activating means connected to said first and second portions thereof providing said time indication in response to said wearer touching the other of said conductive portions, thereby to complete an external electrical circuit between said first and second portions.

5. The watch of claim 4 wherein said affixing means are arranged removably to affix said watch to a wearer's ear.

6. The watch of claim 4 wherein said affixing means are arranged removably to affix said watch to be worn on a chain around wearer's neck.

7. The watch of claim 4 wherein said affixing means are arranged removably to affix said watch to be worn on a wearer's wrist.

* * * * *